United States Patent [19]

Dolgin

[11] Patent Number: 4,737,340

[45] Date of Patent: Apr. 12, 1988

[54] HIGH PERFORMANCE METAL ALLOYS

[75] Inventor: Benjamin P. Dolgin, Chicago, Ill.

[73] Assignee: Allied Corporation, Morristown, N.J.

[21] Appl. No.: 901,677

[22] Filed: Aug. 29, 1986

[51] Int. Cl.[4] ..... C22C 1/04

[52] U.S. Cl. ..... 420/129; 420/590

[58] Field of Search ..... 420/590; 75/129, 130, 75/951; 148/425, 426, 432

[56] References Cited

U.S. PATENT DOCUMENTS

| | | | |
|---|---|---|---|
| 3,194,656 | 7/1965 | Vordahl | 75/135 |
| 3,779,714 | 12/1973 | Nadkarni et al. | 29/182.5 |
| 4,297,135 | 10/1981 | Giessen et al. | 75/123 B |
| 4,436,560 | 3/1984 | Fujita et al. | 148/6 |
| 4,437,890 | 3/1984 | Hayasaka et al. | 75/244 |
| 4,439,236 | 3/1984 | Ray | 75/123 B |
| 4,439,247 | 3/1984 | Arita et al. | 148/2 |
| 4,540,546 | 9/1985 | Giessen | 420/590 |

*Primary Examiner*—Christopher W. Brody

*Attorney, Agent, or Firm*—Thomas K. McBride; John F. Spears, Jr.; E. Jerome Maas

[57] ABSTRACT

High performance metallic alloys which possess desirable characteristics such as high electrical conductivity, high strength, lightness, high thermal stability, etc. may be prepared by admixing three metals or metalloids by mechanical means. The process will result in the formation of a matrix material consisting of one metal and an intermetallic compound comprising the other two metals or metalloids to provide a finished alloy with the desirable characteristics hereinbefore set forth. The intermetallic compound will be present in a uniform dispersion in the matrix material in the form of particles which possess a size in the range of from about 0.001 to about 0.5 microns.

18 Claims, No Drawings

HIGH PERFORMANCE METAL ALLOYS

BACKGROUND OF THE INVENTION

The necessity for high performance metallic alloys has increased within the past few years. For example, electronic devices require alloys which possess certain desirable characteristics such as high strength, high electrical conductivity, lightness, high temperature oxidation resistance, high thermal stability, etc. In order to obtain these high performance alloys, it is necessary to combine the metallic components in such a manner so as to provide the desirable traits to the finished product.

In this respect, various techniques have been employed to produce the desired alloys. For example, beryllium-copper alloys find a wide variety of use in electronic devices due to their combination of properties. However, in machining these alloys to their desired shape or form, toxic beryllia containing dust is emitted during the production and machining which is hazardous in an environmental sense and is very difficult to handle. Therefore, this emission of toxic dust represents a distinct disadvantage attendant to the use of such an alloy. Additionally, the precipitate hardening particles which are present in the beryllium-copper alloy have only marginal thermal stability and will coarsen when the alloy is heated above a temperature of about 400° C. This will cause the alloy to lose its desired properties if it is utilized at or above this temperature. Conventional processing methods such as casting possess certain disadvantages which will prevent the production of a wide variety of desired alloy combinations. For example, a particular disadvantage which is present when casting many alloys is that the alloys are plagued with massive segregation of the alloys. Once this segregation occurs, further refinement of the structure is not possible. Therefore, the most beneficial properties cannot be utilized. Another disadvantage which is found when employing a conventional casting technique is that in addition to a large scale segregation during the cooling, it is also possible that uncontrolled precipitation will occur. In the more conventional precipitation-hardened alloys, a high temperature solution annealing step is used to refine the structure of the alloy. A secondary heat-treatment is then required to produce the dispersed precipitates. Therefore, these are additional steps which are required to obtain the desired product. These solution annealed and heat-treated alloys generally do not have good high temperature properties because high temperatures cause the dispersed phase to go back into solution or substantially coarsen.

Several known patents are directed to various methods for preparing metal alloys. For example, U.S. Pat. No. 4,297,135 teaches the addition of borides, carbides and silicides into various metals such as iron, cobalt, nickel or chromium. However, fine binary boride particles of these metals as well as carbides and silicides alone have a low stability at high temperatures so that they grow to sizes too large to effectively strengthen the alloy, and therefore the resultant alloys possess less than an optimum high temperature property. In addition to this, the metals with very large particles per se are initially brittle and therefore cannot be utilized without a subsequent heat treatment. In U.S. Pat. No. 4,436,560, a method is disclosed for dispersing fine boride particles near the surface of the material. Inasmuch as the mechanical properties of an alloy are a function of the bulk of the material, the method which is disclosed in this patent would not result in the production of high strength alloys. Likewise, in U.S. Pat. No. 4,437,890, a method is disclosed which utilizes a relatively small amount of boron to supress copper growth during the sintering step of the process. The small amounts of boron which are utilized would not be sufficient to form the dispersed strengthening particles which the intermetallic compounds of the present invention impart to the finished alloy.

In U.S. Pat. No. 4,439,236, a process is disclosed for the addition of boron into alloys which contain a minimum of 30 atomic percent of at least two metals selected from the group consisting of iron, cobalt and nickel. The large addition of boron into these alloys would result in imparting desirable properties to the alloys at low temperature. It is to be noted that the borides of iron, cobalt and nickel possess only marginal high temperature stability, and therefore these alloys would not posess such desirable properties as high strength at high temperatures. The large amount of borides in these alloys would also substantially reduce ductility making the alloys difficult to process. U.S. Pat. No. 4,439,247 discloses a method which teaches the addition of small amounts of chromium and tin into copper to produce a high strength, high electrical conductivity copper. However, the alloy thus produced would require a series of hot working, cold working and age hardening steps prior to use. It is readily understandable that the necessity for employing these steps would be highly undesirable in a process to obtain an alloy which possesses desirable characteristics. Tin is also highly soluble in solid copper so that even small amounts would have a negative effect on electrical conductivity. Japanese Pat. No. 156743 discloses the internal oxidation of silicon and/or germanium metals in silver to produce stable oxide dispersoids. Inasmuch as the oxygen has to diffuse in from the surface of the particle, the oxide dispersoids are mostly concentrated near the surface thereof. The oxide particles are very difficult to disperse in an even and uniform manner throughout the alloy, and thus the resultant alloy would possess inhomogeneous regions or dispersions which would impart variations of properties in the alloy, these variations not being desirable characteristics for the alloy.

Another U.S. Patent namely U.S. Pat. No. 3,194,656, also relates to a method of making composite articles such as alloys. However, this patent refers to the fact that at least one of the ingredients in the alloy possesses a liquidus temperature which is substantially below that of the matrix metal and thus would limit the ingredients in the composite article to mostly eutectic systems. Also, this patent refers to the high melting compound elements reacting in the liquid and thus are held to the formation sites. Because of high diffusion rates in the liquid, these nucleation sites are normally widely spaced thus forming particles which are too large to effectively strengthen the alloy. In addition, by stating that the liquidus temperature is substantially below that of the matrix metal, it would suggest that even shallow eutectics would also be eliminated. Furthermore, this patent does not address the solubility into molten matrix of the elemental components which are added to form the compound. Many alloying components can not be kept dispersed by holding at temperatures below the matrix. Likewise, this patent further states that the high melting point compound must be a combination of a metal and a non-metal. Also, this patent does not address the kinetics of the reaction. Once the mix is begun, a high reaction rate will prevent further mixing, thus preventing homogeneous castings.

In contradistinction to this patent, the present invention, as will be shown in the following specification, does not limit the ingredients of the alloy to those systems which have a lower melting temperature and therefore peritectic systems are acceptable. Furthermore, it has now been discovered that a low solubility of both elemental components in the solid matrix is beneficial for the reaction to occur. One advantage of this low solubility of the elemental components is that it forces the additions out of solution.

As will hereinafter be shown in greater detail, it has now been discovered that by utilizing certain metallic components which possess certain characteristics, it is possible to obtain metallic alloys which may be designated as high performance alloys due to the fact that they possess highly desirable characteristics of the type hereinbefore set forth such as high strength, conductivity, lightness, thermal stability, etc. In addition, the intermetallic particles will not agglomerate and will remain in the desired particle size and will be uniformly distributed through the matrix material after admixture.

BRIEF SUMMARY OF THE INVENTION

This invention relates to a process for producing high performance metallic alloys. More particularly, the invention is concerned with a method for the production of alloys possessing desirable characteristics such as high strength, high wear resistance, high thermal stability, etc. by mechanical alloying. It has been found that by combining an intermetallic compound, it is possible to finely and uniformly disperse particles of this compound through a matrix material to impart the desirable characteristics previously described to the final alloy material.

It is therefore an object of this invention to provide a method for producing a high performance metallic alloy.

A further object of this invention is found in a method for producing a high performance metallic alloy which possesses desirable physical as well as electrical properties.

In one aspect, an embodiment of this invention resides in a method for the production of a high performance metallic alloy which comprises mechanically admixing two binary alloys in the solid state, the first binary alloy comprising a subsequent matrix material and a metal component of a subsequent intermetallic compound with a second binary alloy comprising the subsequent matrix material and a dissimilar metal, or mechanically admixing one binary alloy comprising the subsequent matrix material and a metal component of a subsequent intermetallic compound with a singular dissimilar metal comprising the second component of said subsequent intermetallic compound, said intermetallic compound possessing great thermal stability in which said intermetallic compound is present in said matrix material in the form of dispersion particles which possess a size in the range of from about 0.001 to about 0.5 microns, and recovering said high performance metallic alloy.

A specific embodiment of this invention is found in a method for the production of a high performance metallic alloy which comprises admixing a binary alloy of copper and boron with a binary alloy of copper and zirconium at ambient temperature to form an alloy comprising a copper matrix and an intermetallic compound of zirconium and boron in which particles of said intermetallic compound are finely dispersed through the copper matrix, and recovering said alloy.

Other objects and embodiments will be found in the following further detailed description of the invention.

DETAILED DESCRIPTION OF THE INVENTION

As hereinbefore set forth, the present invention is concerned with high performance metallic alloys, and also to a method for the preparation of these compounds. Heretofore, many of the additions to an alloy which were intended for dispersed intermetallic strengthening have not been effective in producing the desired result. As an example, some alloying additions produced by conventional metallurgical techniques afforded no rapid solidification and remained in solution rather than as second phase precipitates, thus resulting in imparting a poor electrical and thermal conductivity to the alloy. Another problem which arose for the conventional processing was that the intermetallic dispersion, rather than being in a finely dispersed small particle state, were in the form of very coarse or large particles, this state of the intermetallic dispersion resulting in imparting less than optimum mechanical properties to the final alloy. A possible cause for the coarseness of the intermetallic dispersion was the overheating of the alloy during a high temperature operation or segregation during casting. This coarseness occurs when the intermetallic compounds are not carefully chosen to have high thermal stability. The melting point of the intermetallic is a good indication of its stability and will be used hereafter to represent the stability of the intermetallic. Therefore, intermetallic compounds with lower melting points, such as those which possess melting points close to the melting points of the alloy matrix, will not in themselves have the desired thermal stability. Many conventional alloys contain these marginal intermetallics due to the fact that these alloys are relatively easy to produce. However, the net result is that the mechanical, as well as other, properties are less than desired.

In order to overcome the aforesaid disadvantages which have been attendant with the production of alloys according to the prior art, it is necessary that the metallic additions to the matrix form a fine dispersion of thermally stable particles in relatively small size which are uniformly dispersed in a relatively solute-free matrix. The alloys which are produced according to the process of this invention are formed from mechanically mixing two alloys, each of which contains the subsequent matrix material and one intermetallic component of the subsequent intermetallic compound. An alternative method would involve the mechanical mixing of a binary alloy of the matrix material containing one intermetallic component with the unalloyed second intermetallic component to produce the final alloy containing said intermetallic component.

As will hereinafter be demonstrated, it is necessary that several criteria be present in order to insure the production of a high performance alloy which possesses desirable physical and electrical characteristics. Among the necessary criteria which must be present are that the intermetallic compound which is formed during the reaction will have a high thermal stability with a melting point of the intermetallic compound usually higher than the melting point of the matrix material; that the intermetallic alloying elements should possess a high solubility in the liquid phase of the binary alloy in order to insure a uniform and even dispersion throughout the matrix as well as the ability to have relatively large amounts of intermetallic compound present in the alloy, that is, amounts of from about 0.1 to about 15% by weight of the alloy; and that the elements comprising the intermetallic compound possess a low solubility in the matrix material in the solid phase in order to impart desirable characteristics such as greater electrical conductivity to the alloy. The high mechanical properties will be due to the fine uniform dispersion of the intermetallic compound throughout the matrix material.

It is important to realize that the requisite particle size cannot be achieved by mixing the intermetallic alloying elements into the molten matrix material since this will afford a precipitation of large particles of the intermetallic while the matrix material is still molten and will prevent the use of conventional and rapid solidification techniques.

It has now been discovered that certain intermetallic compounds which are formed from various metals and which possess very high melting temperatures will have a strong affinity for each other, thus imparting a high thermal stability. By utilizing such intermetallic compounds as strengthening agents for the alloy, it has been found possible to prepare alloys in which the aforesaid intermetallic compounds are in the form of relatively small particles, that is, particles which possess a size in the range of from about 0.001 to about 0.5 microns.

As was hereinbefore set forth, the disposed intermetallic compounds which form the fine particles which, in turn, act as strengthening agents for the alloys will comprise mixtures of said compound in the matrix material, the melting point of said compound being high, in most cases greater than the melting point of the matrix material. As representative examples of some of the intermetallic compounds that can be formed in a copper matrix during the alloying step from the mixture of the components will include, but are not limited to, the metals or metalloids including cobalt/zirconium, CoZr, (melting point 1590° C.); iron/zirconium, $Fe_2Zr$, (melting point 1647° C.); boron/titanium, $TiB_2$, (melting point 3232° C.); boron/zirconium $ZrB_2$, (melting point 3252° C.); chromium/boride, CrB, (melting point 2090° C.); chromium/boron, $CrB_2$, (melting point 2200° C.); iron/titanium, $Fe_2Ti$, (melting point 1429° C.); chromium/zirconium, CrZr, (melting point 1678° C.); niobium/iron, $NbFe_2$, (melting point 1657° C.); niobium/iron, NbFe, (melting point 1800° C.); niobium/carbon, NbC, (melting point 3613° C.); chromium/carbon, $Cr_3C_6$, (melting point 1576° C.); iron/carbon, $Fe_3C$, (melting point 1227° C.); niobium/chromium, NbCr, (melting point 1733° C.); zirconium/carbon, ZrC, (melting point 3427° C.); hafnium/boron, $HfB_2$, (melting point 3380° C.); molybdenum/boron, MoB, (melting point 2600° C.); cobalt/zirconium, CoZr, (melting point 1590° C.); niobium/boride, NbB, (melting point 2917° C.); niobium/boron, $NbB_2$, (melting point 3036° C.); iron/boride, FeB, (melting point 1540° C.); iron/boron, $FeB_2$,(melting point 2070° C.); chromium/carbide, $Cr_7C_3$, (melting point 1765° C.); hafnium/carbide, HfC, (melting point 3928° C.); tantalum/carbide, TaC, (melting point 3985° C.); titanium/carbide, TiC, (melting point 3067° C.); vanadium/carbide, VC, (melting point 2648° C.), zirconium/carbide, ZrC (melting point 3540° C.); iron/carbide, $Fe_3C$, (melting point 1837° C.); cobalt/silicide, $Co_2S$, (melting point 1327° C.); cobalt, silicon, CoSi, (melting point 1395° C.), etc. For purposes of this invention the term "metal" as used in the present specification and appended claims will include both metals and metalloids and the elements boron and silicon. The elements which are components of these intermetallic compounds all possess a low solubility in a solid matrix material such as copper while also possessing a fairly high solubility when the matrix material such as copper is in liquid form. In addition, the intermetallic compounds which are formed will usually have higher melting points than the matrix metal. The metals which form the intermetallic compound may be present in ratios ranging from about 1:1 to about 5:1 by weight of one of the intermetallic metals per the other metal; however, a stoichiometric ratio of the metals is preferred. It is to be understood that the aforementioned intermetallic compounds are only representative of the class of intermetallic compounds which will act as strengthening agents, the only criteria of the mixture of metals forming said intermetallic compound being that said intermetallic compound possess the physical properties including a melting point preferably greatly in excess of that of the matrix material, and the elements forming the intermetallic must have high solubility in the liquid phase and low solubility in the matrix material in the solid phase. In addition, by utilizing a mechanical alloying, it is also possible to uniformly disburse the intermetallic compounds which, as hereinbefore set forth, are in the form of relatively small particles ranging from about 0.001 to about 0.5 microns in size uniformly disbursed throughout the matrix material, thus adding to the strength of the matrix material.

The matrix material or metal in which the intermetallic compound is evenly and uniformly distributed in the form of particulate material will include those metals which are useful for particular processes in order to produce a high performance alloy. Some representative examples of these metals which act as matrix materials will include highly conductive metals such as copper, nickel, iron, cobalt, other Group VIII B metals, etc., and light weight metals such as aluminum, magnesium, titanium, etc. In the preferred embodiment of the invention, the intermetallic compound which is formed during the alloying method will be present in the high performance alloy in an amount in the range of from about 0.1 to about 15% by weight of the matrix material with a preferred range of from about 5 to 10%.

The high performance alloys of the present invention may be prepared utilizing mechanical alloying in a temperature range of from about 0° C. to about 300° C. under an inert gas atmosphere such as, for example, argon or nitrogen. One method of preparation of the desired alloy comprises admixing two binary alloys in the form of ribbons, foil, or powder. When this type of method is used, the alloys which, for purposes of illustration, may comprise a copper-boron alloy and a copper-zirconium alloy, are placed in an appropriate container under an inert gas atmosphere along with ball bearings and a stirrer. After stirring in this attriton grinding apparatus for several hours, the resultant powder is collected and the high performance alloy will be found to contain zirconium boride in a copper matrix. Other methods of mechanical grinding can be used and include, though not limited to, ball milling, as well as air jet grinding in which an air stream causes particles of the binary alloys to impinge upon each other to form the requisite high performance alloy. Prior attempts to prepare this alloy utilized cold rolling unsuccessfully while the method of this invention combined with cold rolling improved the mechanical properties of a Cu/Zr/B alloy wherein a conductivity equal to 50% of pure copper was achieved as well as a yield stress of 115 Ksi without heat treatment.

The method of this invention depends on heavy mechanical deformation of the above-described alloys to bring the individual layers of precursor alloys into a state where at least one characteristic dimension of these layers is below one micron and leads to melding and consolidation of the alloys and to their homogenization. Included in such mechanical mixing processes are repetitive cold and/or hot rolling of mixed and/or extruded foils or powders, and repetitive swaging of mixed and/or extruded foils or powders. Additional variations on this invention include methods capable of producing thin alternating layers of materials such as electrodeposition, chemical deposition, evaporation, and sputtering, each of which would afford a starting material different from the binary alloys described hereinabove.

The particles which have been obtained by mechanical mixing can be consolidated by placing in an appropriate extrusion mold or by hot isostatic pressing. The extrusion mold or a vessel may, for example, comprise a metal tube, usually of a tool steel or superalloy construction having a die orifice at one end of the tube. The orifice through which the material is extruded may be of any configuration such as square, rectangular, round, "L" shape, or "T" shape, etc. depending upon the desired final configuration of the material. A piston, with dimensions similar to that of the tube, is utilized to apply the pressure at one end of the tube necessary for extruding the alloy through the die orifice. The extrusion vessel is then heated, or prior to introduction to the extrusion vessel, the alloys are then heated to a temperature which may range from about 300° C. to about 1000° C. or more, the temperature being dependent upon the particular matrix metal which is present in the high performance alloy. The particular intermetallic compound which is present as fine randomly dispersed particles will preferably be present in the solid state due to the low solubility of said intermetallic compound in the matrix material and their high melting temperature. Following the heating of the alloy to the desired temperature, it is then extruded through the die orifice to form the desired product.

It is also contemplated as within the scope of this invention that the high strength alloy may also be prepared by mechanically mixing, as hereinbefore described, a binary alloy of the matrix metal and one component of the subsequent intermetallic compound with the other singular component of the intermetallic compound, and recovering the high performance alloy.

Also contemplated as within the scope of this invention is the inclusion of a second intermetallic component into one or both of the precursor alloys so as to form a ternary mixture to help precipitate the final intermetallic substance.

The following examples are given for purposes of illustrating several high performance alloys and to a process for the preparation thereof. However, it is to be understood that these examples are given merely for purposes of illustration and that the present process is not necessarily limited thereto.

EXAMPLE I

Precursor binary alloys of copper with 5 atom % zirconium and with 10 atom % boron were prepared by arc remelting. The alloys were melt-spun and the resulting ribbons were chopped in a blender to give a −50 mesh powder. The two binary powders were mixed in equal amounts and placed in a milling vial. Typically the load placed in a vial was 20 g of each alloy powder, 5 ml of toluene, and 65 g of ball pestles. The vials were then placed in a Spex 8000 mixer mill for 24 hours and the resultant powder was hot pressed at 650° C. and 90 Ksi pressure. An alloy had a conductivity of 20% IACS and a Knoop hardness of about 325 Ksi. This alloy shows evenly distributed 0.05–0.1 micron intermetallic precipitates created through the mechanical alloying.

EXAMPLE II

As described in Example I, precursor binary alloys of copper with 5 atom % zirconium and with 10 atom % boron were prepared and then hot pressed at 750° C. to give a resulting alloy having a Knoop hardness of 275 and an electrical conductivity of 25% IACS and containing particles of zirconium-boron with an average size of 0.1 micron.

EXAMPLE III

Samples of alloys prepared as described in Example II were annealed at temperatures up to 1000° C. in Argon which had been purified by an oxygen scavenger. These samples showed a loss of hardness that did not decrease below Knoop 260 and possessed a particle size average of 0.3 microns.

EXAMPLE IV

Examples of copper alloys with chromium and niobium additions can be prepared in a manner as described in Example I and would produce an alloy which has a dispersion of chromium-niobium compound with a precipitate size below 0.25 microns and which would possess a Knoop hardness of about 250 as well as 40% IACS.

EXAMPLE V

A powder of nickel containing 5 atomic percent boron and a powder of nickel containing 5 atomic precent vanadium can be mechanically alloyed in a Spex mixer mill for 24 hours to give a powder which will contain submicron precipitates of a vanadium-boron compound possessing a Knoop hardness of about 270 and a particle size of about 0.2 microns.

I claim as my invention:

1. A method for the production of a high performance metallic alloy which comprises mechanically admixing two binary alloys in the solid state under conditions which result in the melding and consolidation of such alloys, the first binary alloy comprising a subsequent matrix material and a metal component of a subsequent intermetallic compound with a second binary alloy comprising the subsequent matrix material and a dissimilar metal, or mechanically admixing one binary alloy comprising the subsequent matrix material and a metal component of a subsequent intermetallic compound with a singular dissimilar metal comprising the second component of said subsequent intermetallic compound, said mechanical admixing step occurring under conditions which result in the melding and consolidation of such alloys to yield said high performance metallic alloy comprised of said intermetallic compound and said matrix material, said intermetallic compound being present in said matrix material in the form of a dispersion of particles which possess a size in the range of from about 0.001 to about 0.5 microns, and recovering said high performance metallic alloy.

2. The method as set forth in claim 1 further characterized in that said binary alloy may contain an additional intermetallic component.

3. The method as set forth in claim 1 in which each of the components of said intermetallic compound separately possess a high solubility in the matrix material in liquid form.

4. The method as set forth in claim 1 in which said intermetallic compound possesses a low solubility in the matrix material in solid form.

5. The method as set forth in claim 1 in which the particles of said intermetallic compound are uniformly dispersed throughout said matrix material.

6. The method as set forth in claim 1 in which said intermetallic compound is present in said high performance metallic alloy in an amount in the range of from about 0.1% to about 15% by weight of said alloy.

7. The method as set forth in claim 1 in which said metal which comprises said matrix material is copper.

8. The method as set forth in claim 1 in which said metal which comprises said matrix material is a Group VIII B metal.

9. The method as set forth in claim 8 in which said metal which comprises said matrix material is nickel.

10. The method as set forth in claim 8 in which said metal which comprises said matrix material is iron.

11. The method as set forth in claim 8 in which said metal which comprises said matrix material is cobalt.

12. The method as set forth in claim 1 in which said intermetallic compound consists of a mixture of cobalt and zirconium. .

13. The method as set forth in claim 1 in which said intermetallic compound consists of iron and zirconium.

14. The method as set forth in claim 1 in which said intermetallic compound consists of boron and a metal selected from the group consisting of zirconium, titanium, iron, chromium and cobalt.

15. The method as set forth in claim 1 in which said intermetallic compound consists of niobium and iron.

16. The method as set forth in claim 1 in which said intermetallic compound consists of chromium and niobium.

17. The method as set forth in claim 1 in which said intermetallic compound consists of carbon and a metal selected from the group consisting of zirconium, titanium, iron, chromium, and cobalt.

18. The method as set forth in claim 1 in which said intermetallic compound consists of silicon and a metal selected from the group consisting of zirconium, titanium, iron, chromium, and cobalt.

* * * * *